United States Patent [19]

Miles, Jr.

[11] Patent Number: 4,518,896

[45] Date of Patent: May 21, 1985

[54] DUAL VOLTAGE LIGHTING FIXTURE

[75] Inventor: Earl F. Miles, Jr., Indianapolis, Ind.

[73] Assignee: Indy Lighting, Inc., Indianapolis, Ind.

[21] Appl. No.: 395,497

[22] Filed: Jul. 6, 1982

[51] Int. Cl.[3] ..... H05B 37/00

[52] U.S. Cl. ..... 315/162; 315/165; 315/254; 315/312; 362/147; 362/228; 362/254

[58] Field of Search ..... 315/57, 70, 162, 165, 315/254, 257, 312; 362/254, 228, 20, 147

[56] References Cited

U.S. PATENT DOCUMENTS

| | | | |
|---|---|---|---|
| 1,631,632 | 6/1927 | Hanorson | 362/227 |
| 2,309,448 | 1/1943 | Grumwald | 362/254 |
| 2,343,822 | 3/1944 | Tuck | 362/228 |
| 2,442,569 | 6/1948 | Kennelly | 362/227 |
| 2,540,015 | 1/1951 | Solow | 315/165 |
| 3,040,285 | 6/1962 | Stanley | 339/64 |
| 3,120,419 | 2/1964 | Dworkin | 339/168 |
| 3,660,651 | 5/1972 | Miles | 240/73 BJ |
| 3,679,931 | 7/1972 | Powell | 315/162 |
| 3,784,811 | 1/1974 | Feder | 362/227 |
| 4,285,028 | 8/1981 | Sundin | 362/35 |

*Primary Examiner*—Harold Dixon

*Attorney, Agent, or Firm*—Woodard, Weikart, Emhardt & Naughton

[57] ABSTRACT

A dual voltage lighting fixture for permiting the interchangeable use of light bulbs having substantially different operating voltages. The apparatus includes a housing to which is mounted a standard sized light bulb socket and a connector. A transformer is also mounted to the housing and serves to deliver electrical current to the socket and connector at substantially different operating voltages. A manually operated switch controls the supply of electrical current between the socket and the connector. A detachable fixture for receiving a smaller sized low voltage light bulb is also provided which is attached to the housing and connector. The detachable fixture may be removed whenever it is desirable to use a standard sized light bulb.

6 Claims, 3 Drawing Figures

DUAL VOLTAGE LIGHTING FIXTURE

BACKGROUND OF THE INVENTION

1. Field of the Invention

The present invention relates to the field of lighting fixtures.

2. Description of the Prior Art

Recent advances in the technology surrounding the design and manufacture of electric light bulbs have achieved the development of a low voltage light bulb having a relatively high level of illumination compared to the typical 120-volt light bulb commonly used for residential and commercial room lighting purposes. These new light bulbs are capable of producing levels of illumination comparable to typical 120-volt light bulbs using only 12 volts, yet retaining acceptable levels of overall energy efficiency. Further, because of the much lower operating voltage required, these new light bulbs have a much longer operating lifetime than typically found for comparable 120-volt light bulbs having previous designs. A further advantage afforded by these new light bulbs is their much smaller overall size, which is about the size of a typical flashlight bulb. As a result, the new low voltage light bulbs are gaining widespread popularity.

One drawback concerning the potential market for the new light bulbs is that while they are much smaller than ordinary light bulbs, this means that they cannot readily fit into existing standard sized light fixture sockets. A further disadvantage is that since the new light bulbs operate on much lower voltages than typical line voltages, a voltage step down is necessary. Thus, an individual or business installing the low voltage light bulbs in an existing building must either install new fixtures specially made for the new light bulbs or buy adapters which permit the use of the new light bulbs in standard light fixtures. While the adapters currently available obviate the need to replace the entire light fixture, they are also very expensive to produce. Further, fixtures specially made for the new light bulbs cannot economically be converted to allow the use of standard voltage bulbs should their use subsequently be desired for any reason.

Several patent references disclose devices which may have some relevance to the present invention. U.S. Pat. No. 3,660,651 to Miles, Jr. discloses an adjustable light fixture which is recessible in a ceiling for directing light at various angles toward an object. This device while having a similar external shape to the present invention is different in that it does not disclose a fixture capable of using light bulbs having substantially different operating voltages.

U.S. Pat. No. 3,120,419 to Dworkin discloses an adapter for electric lamps provided with spaced prongs as opposed to a conventional screw plug base. This adapter, however, also does not afford the capability of operating light bulbs having substantially different operating voltages.

U.S. Pat. No. 3,040,285 to Stanley discloses a connector structure for providing a sealed connection of predetermined polarity between an electric light bulb and electric conductors with the bulb and conductors in any relative angular position. U.S. Pat. No. 4,285,028 to Sundin, et al. discloses a combination bedroom lamp and clock which uses two different wattage light bulbs separated by a time delay switch mechanism.

West German Pat. No. 1780050 discloses a light fixture for use as a tail light of an automobile which would have an auxiliary cord which could be used for attaching trailer lights to the automobile.

None of the devices described above discloses the dual voltage lighting fixture concept or capability of the present invention, nor do they afford the other advantages previously mentioned.

SUMMARY OF THE INVENTION

One embodiment of the present invention comprises a dual voltage lighting fixture which permits the interchangeable use of light bulbs having different operating voltages. The lighting fixture includes a housing, circuit means for receiving an electrical current at a single supply voltage and providing electrical current at first and second output voltages, and connecting means attached to said housing for connecting the output voltages to light bulbs of corresponding operating voltages. The connecting means includes a first socket electrically connected with the circuit means to receive current at the first output voltage and is adapted for receiving a light bulb having a corresponding operating voltage. The second socket is electrically connected with the circuit means to receive current at the second output voltage and is adapted for receiving a light bulb having a corresponding operating voltage.

It is an object of the present invention to provide a lighting fixture which permits the ready use of light bulbs having substantially different operating voltages.

It is a further object of the present invention to provide a dual voltage lighting fixture which is safe and easy to use, and which is economical to make and install.

Another object of the present invention is to provide a lighting fixture accomplishing the objects set forth above, yet which is no larger than previous similarly designed standard light fixtures, and has an attractive overall appearance.

These and other objects and advantages of the present invention will become more apparent in the following figures and detailed description.

DESCRIPTION OF THE PREFERRED EMBODIMENT

Figure 1:
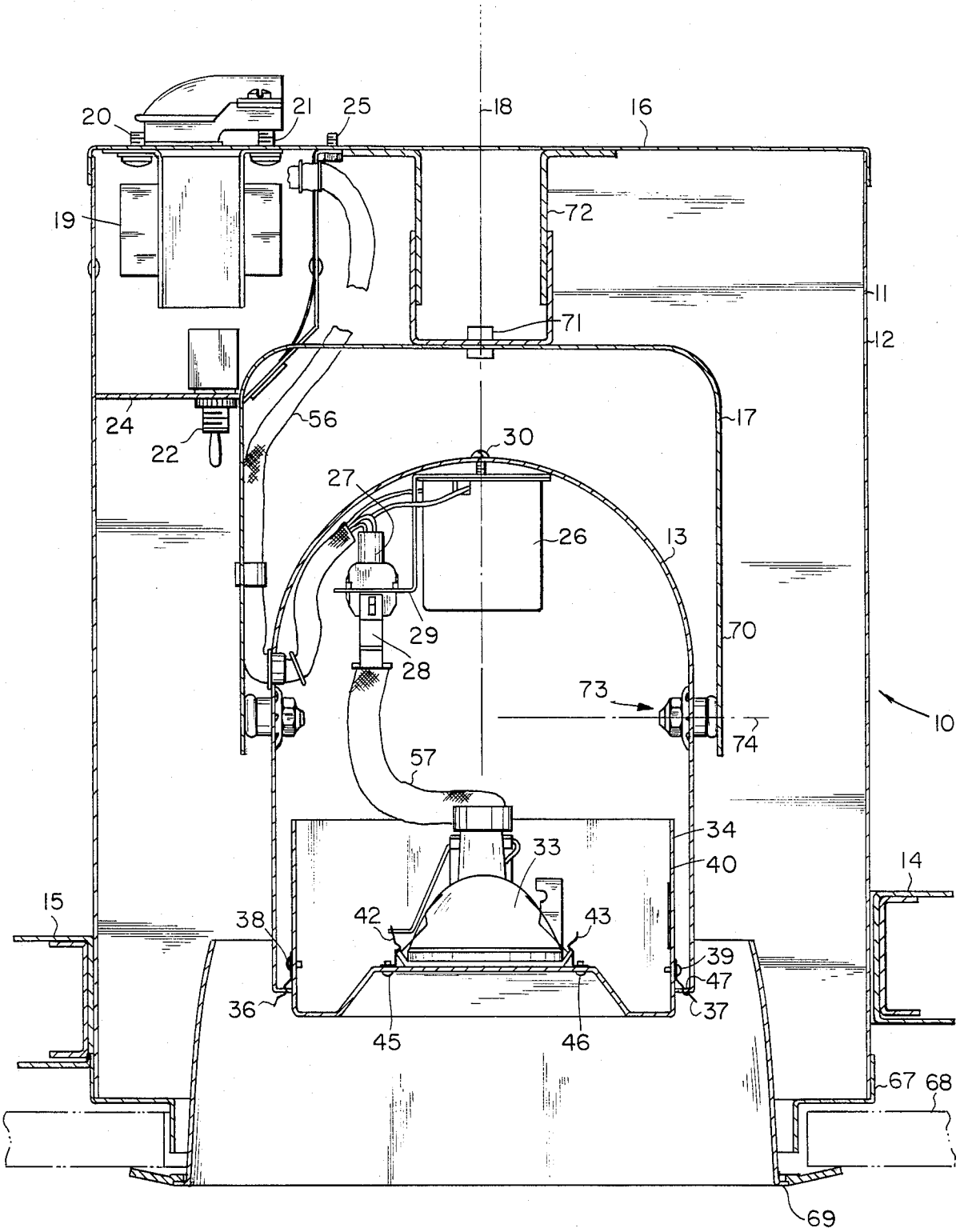
FIG. 1 is a sectional view, largely in schematic, of a dual voltage lighting fixture constructed in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, and more particularly to FIG. 1, there is shown a dual voltage lighting fixture 10 in a sectional view. Fixture 10 includes a housing 11 having a sidewall 12 and beam-directing shade 13 which is enclosed by sidewall 12. Fixture 10 is designed to be recessed in a ceiling or wall and mounted thereto by C-shaped bars 14 and 15. These bars may, for example, span between and be secured to ceiling joists in conventional fashion, and are typically telescoping in nature to accommodate variously spaced joists. The fixture 10 preferably includes a rim member 67 positioned over the bottom edge of the sidewall 12 for reception of the finished ceiling surface 68, and a cover assembly 69 is mounted against the ceiling surface for the desired aesthetic appearance.

Shade 13 is mounted to top wall 16 by mounting assembly 17 which is rotatable on vertical axis 18. Assembly 17 may include a C-shaped bracket 70 pivotally secured, such as by a rivet 71, to a mounting bracket 72 attached to the top wall 16. Shade 13 is pivotally attached to assembly 17 by means of bolt and nut combinations 73 to thereby be pivotable about a horizontal axis 74, which allows shade 13 to be inclined with respect to vertical axis 18. Thus by a combination of pivoting shade 13 and rotating mounting assembly 17, shade 13 may be adjusted to direct light in different directions and at various angles.

A transformer 19 is mounted to top wall 16 via screws 20 and 21. In the preferred embodiment shown in FIG. 1, the transformer 19 is rated at 50 watts and is designed to accept typical 120-volt line voltages across its primary windings. The transformer may have various other embodiments or equivalents, and for example may alternatively be designed for 277-volt line voltages common in many foreign countries. Toggle switch 22 is mounted to wire cover 24 which is in turn secured by screw 25 to top wall 16. Wire cover 24 serves to prevent hand contact with any wiring while switching the toggle switch.

Proceeding now to the interior of shade 13, socket 26 and connector 27 are mounted to bracket 29 which is in turn rigidly secured to shade 13 by screw 30. Socket 26 and connector 27 are electrically connected to an AC current supply via transformer 19 and switch 22, as will be more fully described herein. Socket 26 is a standard sized light fixture socket which allows fixture 10 to accept standard sized light bulbs. Connector 27 is the female member of a conventional mate and lock electrical plug.

A smaller fixture 33 is detachably connected to shade 13 and connector 27, in a position directly below socket 26, by holder assembly 34 and male member 28, respectively. Holder assembly 34 includes a pair of clip springs 36 and 37 attached by rivets 38 and 39 to spin holder 40. Fixture 33 is detachably secured to spin holder 40 via clip springs 42 and 43 which are in turn firmly secured to spin holder 40 by way of rivets 45 and 46. Attaching fixture 33 within shade 13 is thus easily accomplished by inserting male member 28 into connector 27 and then inwardly pressing spring clips 36 and 37 until spin holder 40 is positioned to allow clips 36 and 37 to contact the inner edge formed by flange 47 of shade 13, whereupon the clips are released. It should be understood that while the amount of pressure exerted by spring clips 36 and 37 against the inner edge of flange 47 is sufficient to retain spin holder 40 within shade 13, it is possible to easily rotate the spin holder, and thus also fixture 33, on axis 18. It is readily observed that by a combination of rotating mounting assembly 17 and pivoting shade 13 on mounting assembly 17, a light beam from fixture 33 can be directed over a considerable area. Fixture 33 is adapted to receive a 50-watt lamp produced by General Electric under model No. EP2.

Figure 2:
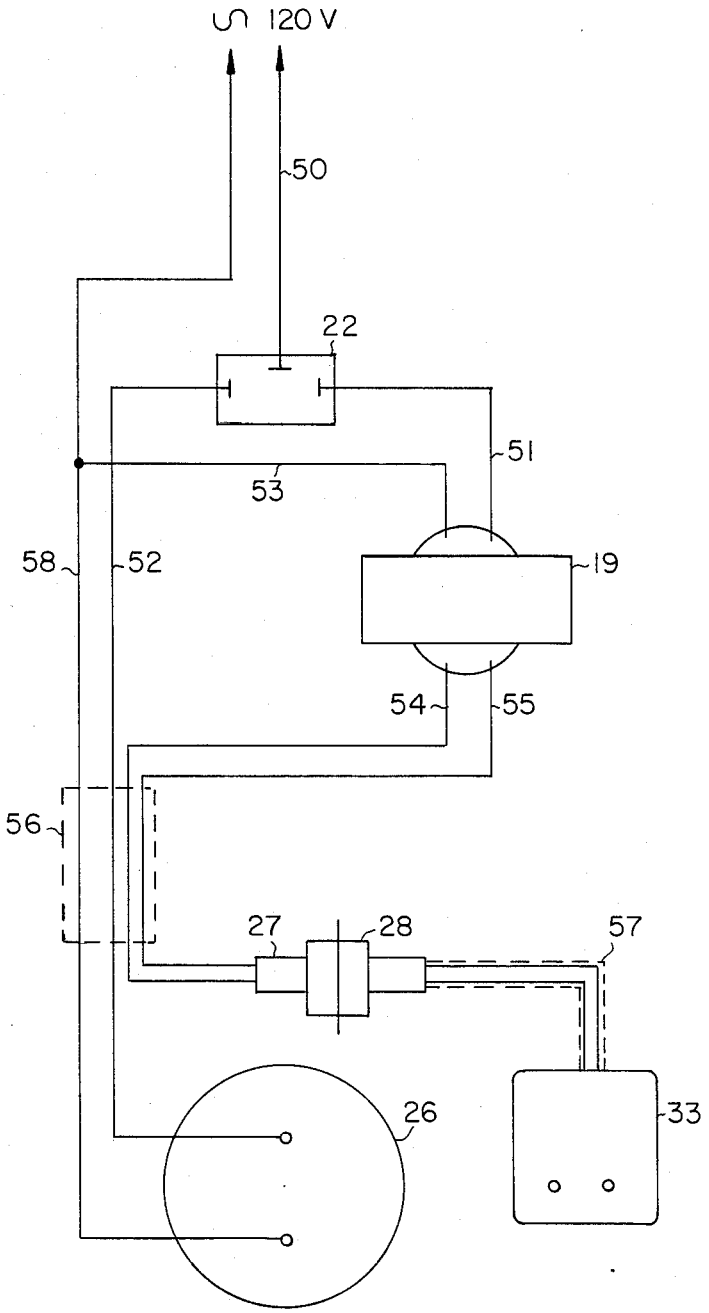
FIG. 2 is a wiring diagram of a lighting fixture according to the present invention adapted for 120-volt line voltage.
Figure 3:
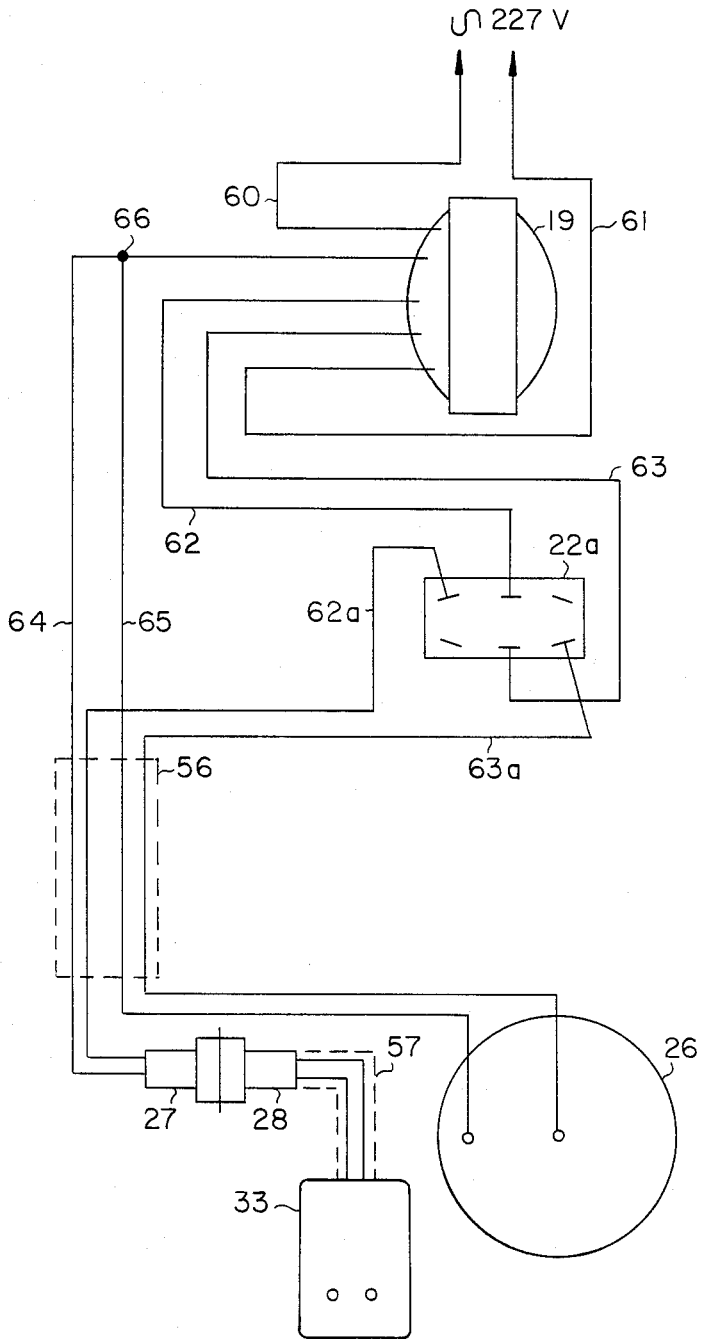
FIG. 3 is a wiring diagram of a lighting fixture according to the present invention adapted for 277-volt line voltage.

As will be further described with respect to FIGS. 2 and 3, the light fixture of the present invention is provided with two light sockets electrically connected with an electrical supply for accommodating light bulbs having different operating voltages. In the preferred embodiment, the electrical supply is connected by wiring with the transformer 19, the toggle switch 22 and the sockets or fixtures 26 and 33. The transformer typically may be provided to convert the electrical supply to two voltages different than the supply voltage, or to provide a second voltage different than the supply voltage. Current at one voltage is provided to socket 26 through the wiring contained in sleeve 56, and at the second voltage is provided to the socket or fixture 33 also through the wiring contained in sleeves 56 and 57. Further details of the circuit means by which the different voltages are provided to the separate sockets are provided in the following description.

Referring now to FIG. 2, a wiring diagram of dual voltage lighting fixture 10 adapted for 120-volt AC line voltages is shown. Switch 22 is connected to a conventional 120-volt AC line voltage through wire 50, and controls the current going to one end of the primary coil of transformer 19 via wire 51 and to socket 26 via wire 52. The other end of the primary coil of transformer 19 is connected through wire 53 to the line voltage wire 58 which is directly connected to socket 26. Connector 27 is connected to the secondary coil of transformer 19 by wires 54 and 55. Dashed line 56 represents the sleeving around the wiring from wire cover 24 to shade 13 and dashed line 57 represents the sleeving around the wiring from male member 28 to fixture 33. It will therefore be understood that the circuit means depicted generally in FIG. 2 provides current to the sockets 26 and 33 at different voltages, and that the provision of current to either socket is controlled by toggle switch 22. In one condititon of toggle switch 22, the wires 50 and 52 are electrically connected and current is provided at a first voltage to socket 26, and therefore to a light bulb having a corresponding operating voltage and being received therein. In the other condition of toggle switch 22, the wires 50 and 51 are electrically connected and current at a second voltage is thereby provided by means of transformer 19 and connectors 27 and 28 to the socket 33, and therefore to a light bulb having a corresponding operating voltage and being received therein.

Referring now to FIG. 3, a wiring diagram of dual voltage lighting fixture 10 adapted for 277-volt AC line voltages is shown. The primary coil of transformer 19 is connected to the 277-volt AC line voltage through wires 60 and 61. Wire 62 carries 12 volts from the secondary coil of transformer 19 to switch 22*a* while wire 63 carries 115 volts from the secondary coil of transformer 19 to switch 22*a*. Wires 62*a* and 63*a* are connected between switch 22*a* and connector 27 and socket 26, respectively. Wires 64 and 65 share a common connection 66 to the secondary coil of transformer 19 which thereby completes the load circuits between connector 27 and transformer 19, and socket 26 and transformer 19, respectively. Again it will be appreciated that current at different voltages is directed to the sockets 26 and 33 by means of the transformer 19 and switch 22*a*. In one condition, the switch 22*a* opens the connection of the wires 62 and 62*a* and closes the connection of wires 63 and 63*a*, thereby providing current at a first voltage to the socket 26. In the other condition, the switch 22*a* opens the connection of the wires 63 and 63*a* and closes the connection of wires 62 and 62*a*, thereby providing current at a second voltage to the socket 33.

Thus, it is seen from the above description that dual voltage lighting fixture 10 allows the use of either a smaller 12-volt high intensity light bulb or a 120-volt light bulb within a common housing. Attachment or removal of fixture 33 is easily and quickly accomplished by a person of normal skills without the need for an electrician. Since socket 26 and fixture 33 are differently sized, it is not possible to connect a low-voltage light bulb to the higher voltage socket. Switch 22 ensures that there is no power going to connector 27 when socket 26 is "on" and vice versa, thus increasing the safety of the fixture. Also, replacing of a low-voltage light bulb from fixture 33 is easily accomplished without removing fixture 33 from connector 27 or shade 13 by merely disconnecting spring clips 36 and 37 from housing 11 and then disconnecting spring clips 42 and 43 from fixture 33.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A dual voltage lighting fixture for permitting the ready use of light bulbs having different operating voltages, comprising:

a housing;

a shade directing means including a yoke rotatably mounted to said housing;

a beam-directing shade pivotably mounted to said yoke;

a lamp supply means mounted to said housing and being for receiving an electrical current at a single supply voltage and providing electrical current at a first output voltage and a second output voltage different from the first output voltage;

a mating connector plug including male and female members, one of said male and female members mounted within said beam-directing shade and electrically connected to said lamp supply means to receive electrical current at said second output voltage;

a first light bulb socket fixedly mounted within said beam-directing shade and adapted to operatively receive therein a first light bulb having an operating voltage corresponding to said first output voltage;

a light fixture including a plurality of spring mounting clips resiliently urging against said beam-directing shade so as to fasten said light fixture within said beam-directing shade and permit removal therefrom by pressing said clips inwardly away from said shade, said light fixture including a second light bulb socket electrically connected to the other of said male and female connector plug members and positioned directly below said first light bulb socket, said second light bulb socket adapted to operatively receive therein a second light bulb having an operating voltage corresponding to said second output voltage, said second light bulb sufficiently different in size from said first light bulb to preclude substitution of said first light bulb in said second light bulb socket, and vice versa; and a switch means mounted to said housing and electrically connected to said lamp supply means for switching electrical current from said supply means to either said first light bulb socket or said second light bulb socket, whereby, only one of said first and second light bulbs is operational in said dual voltage lighting fixture at any time, said detachable fixture being detached from said beam-directing shade and removed from the remainder of said dual voltage lighting fixture to render said first lightbulb operational.

2. The apparatus of claim 1 wherein said first and second light bulb sockets are positioned along the axis of rotation of said yoke.

3. The apparatus of claim 2 wherein said supply means includes a transformer mounted within said housing.

4. The apparatus of claim 3 wherein said first operating voltage is in the range of a 110 to 130 volt AC voltage and said second operating voltage is in the range of a 10 to 14 volt AC voltage.

5. A dual voltage lighting fixture for permitting the ready use of light bulbs having different operating voltages, comprising:

a housing;

a shade directing means including a yoke rotatably mounted to said housing;

a beam-directing shade pivotably mounted to said yoke;

a lamp supply means mounted to said housing and being for receiving an electrical current at a single supply voltage and providing electrical current at a first output voltage and a second output voltage different from the first output voltage;

a first light bulb socket fixedly mounted within said beam-directing shade and adapted to operatively receive therein a first light bulb having an operating voltage corresponding to said first output voltage;

a light fixture including a plurality of spring mounting clips resiliently urging against said beam-directing shade so as to fasten said light fixture within said beam-directing shade and permit removal therefrom by pressing said clips inwardly away from said shade, said light fixture including a second light bulb socket electrically connecting to said lamp supply means and positioned directly below said first light bulb socket, said second light bulb socket adapted to operatively receive therein a second light bulb having an operating voltage corresponding to said second output voltage, said first and second light bulb sockets being positioned along the axis of rotation of said yoke said second light bulb sufficiently different in size from said first light bulb to preclude substitution of said first light bulb in said second light bulb socket, and vice versa; and a switch means mounted to said housing and electrically connected to said lamp supply means for switching electrical current from said supply means to either said first light bulb socket or said second light bulb socket, whereby, only one of said first and second light bulbs is operational in said dual voltage lighting fixture at any time, said detachable fixture being detached from said beam-directing shade and removed from the remainder of said dual voltage lighting fixture to render said first lightbulb operational.

6. A dual voltage lighting fixture for permitting the ready use of light bulbs having different operating voltages, comprising:

a housing;

a shade directing means including a yoke rotatably mounted to said housing;

a beam-directing shade pivotably mounted to said yoke;

a lamp supply means mounted to said housing and being for receiving an electrical current at a single supply voltage and providing electrical current at a first output voltage and a second output voltage different from the first output voltage;

a mating connector plug including male and female members, one of said male and female members mounted within said beam-directing shade and electrically connected to said lamp supply means to receive electrical current at said second output voltage;

a first light bulb socket fixedly mounted within said beam-directing shade and adapted to operatively receive therein a first light bulb having an operating voltage corresponding to said first output voltage;

a light fixture including a second light bulb socket electrically connected to the other of said male and female connector plug members and positioned directly below said first light bulb socket, said second light bulb socket adapted to operatively receive therein a second light bulb having an operating voltage corresponding to said second output voltage, said first and second light bulb sockets being positioned along the axis of rotation of said yoke said second light bulb sufficiently different in size from said first light bulb to preclude substitution of said first light bulb in said second light bulb socket, and vice versa; and a switch means mounted to said housing and electrically connected to said lamp supply means for switching electrical current from said supply means to either said first light bulb socket or said second light bulb socket, whereby, only one of said first and second light bulbs is operational in said dual voltage lighting fixture at any time, said detachable fixture being detached from said beam-directing shade and removed from the remainder of said dual voltage lighting fixture to render said first lightbulb operational.

* * * * *